US009589783B2

(12) United States Patent
Bergmann et al.

(10) Patent No.: US 9,589,783 B2
(45) Date of Patent: Mar. 7, 2017

(54) METHOD FOR IMPROVING THE WETTABILITY OF A ROTATING ELECTRODE IN A GAS DISCHARGE LAMP

(71) Applicants: FRAUNHOFER-GESELLSCHAFT ZUR FOERDERUNG DER ANGEWANDTEN FORSCHUNG E.V., Munich (DE); USHIO DENKI KABUSHIKI KAISHA, Tokyo (JP)

(72) Inventors: Klaus Bergmann, Herzogenrath (DE); Ralf Pruemmer, Geilenkirchen (DE)

(73) Assignees: FRAUNHOFER-GESELLSCHAFT ZUR FOERDERUNG DER ANGEWANDTEN FORSCHUNG E.V., Munich (DE); USHIO DENKI KABUSHIKI KAISHA, Tokyo (JP)

( * ) Notice: Subject to any disclaimer, the term of this patent is extended or adjusted under 35 U.S.C. 154(b) by 313 days.

(21) Appl. No.: 14/150,995

(22) Filed: Jan. 9, 2014

(65) Prior Publication Data

US 2014/0197726 A1 Jul. 17, 2014

(30) Foreign Application Priority Data

Jan. 11, 2013 (DE) ..... 10 2013 000 407

(51) Int. Cl.
*H01J 61/06* (2006.01)
*H05G 2/00* (2006.01)

(52) U.S. Cl.
CPC ..... *H01J 61/06* (2013.01); *H05G 2/005* (2013.01)

(58) Field of Classification Search
CPC ..... H01J 61/06; H05G 2/005; F02P 13/00; H01T 13/16; H01T 13/20; H01T 13/39
See application file for complete search history.

(56) References Cited

U.S. PATENT DOCUMENTS

2010/0181502 A1* 7/2010 Wilhelmus Van Herpen ..... B82Y 10/00 250/504 R
2011/0266724 A1 11/2011 Hulseman et al. ..... 264/603
2012/0212158 A1* 8/2012 Metzmacher ..... H01J 1/02 315/326
2012/0276334 A1 11/2012 Fedynyshyn et al. ..... 428/141

FOREIGN PATENT DOCUMENTS

WO WO 2005/025280 A2 3/2005 ..... H05G 2/00
WO WO 2012/007146 A1 1/2012 ..... H05G 2/00

* cited by examiner

*Primary Examiner* — Nimeshkumar Patel
*Assistant Examiner* — Jacob R Stern
(74) *Attorney, Agent, or Firm* — Renner Kenner Greive Bobak Taylor & Weber

(57) ABSTRACT

The present invention relates to a method for improving the wettability of a rotating electrode with a liquid medium in a discharge lamp, in particular for the production of EUV radiation or soft X-rays, and a correspondingly designed gas discharge lamp. In the method, the edge surface of the rotating electrode to which the liquid medium is applied is microstructured by means of external processing. This microstructure significantly improves the wettability of the edge surface for the liquid medium. Furthermore, the distribution of the liquid medium over the edge surface can be controlled selectively by suitable choice of the microstructure.

16 Claims, 3 Drawing Sheets

METHOD FOR IMPROVING THE WETTABILITY OF A ROTATING ELECTRODE IN A GAS DISCHARGE LAMP

TECHNICAL FIELD OF APPLICATION

The present invention relates to a method for improving the wettability of a rotating electrode with a liquid medium in a gas discharge lamp, in particular for the production of EUV radiation or soft X-ray radiation, in which the liquid medium is applied onto an edge surface of the rotating electrode. The invention also relates to a gas discharge lamp in which at least one of the electrodes has an improved wettability in accordance with the method.

The proposed method and the associated gas discharge lamp can be applied in applications in which, for example, radiation in the extreme ultraviolet spectral range (EUV) or in the soft X-ray radiation range is required, i.e., in the wavelength range between about 1 nm and 20 nm. This relates, for example, to EUV lithography or measurement technology.

PRIOR ART

WO 2005/025280 A2 discloses a gas discharge lamp for generating EUV radiation or soft X-rays, in which the gas discharge is generated in a metallic vapour between two rotating electrodes. For this purpose, the molten metal is applied to the rotating electrodes and evaporated by a laser beam at the site of the discharge. The two electrodes, implemented as circular discs and/or in the shape of a wheel, are immersed in containers with the molten metal in order to apply the metal. They must consist of a substrate material, for example tungsten, that can be wetted with the molten metal. The rotation of the electrodes ensures that the entire edge surface of the electrodes and as much as possible of the side faces are wetted with the molten metal. For technological reasons, the optimum thickness of the molten metallic film on the electrodes is one which is both sufficiently thin to prevent the detachment of droplets at high rotation speeds of the electrodes, and on the other hand sufficiently thick to reduce the thermal loading on the substrate material and to protect the surface against the discharge. In practice, therefore, at the site of the discharge, or of the plasma, the objective is to keep the thickness of the molten metal film between 10 μm and a few 10s of μm. This thickness is usually controlled by appropriate scrapers on the sides and edge faces of the electrodes. The critical thickness of the molten metal film at the site of the plasma then depends on the adjustment of the scrapers, the geometry of the electrodes and the rotation speed.

WO 2012/007146 A1 discloses a method for improving the wettability of the electrodes of a gas discharge lamp, in which the electrodes are first heat treated in a pre-treatment step in contact with the molten metal and subsequently at a temperature above 800° C., in order to obtain a bonding of the substrate material of the electrode and the molten metal in a surface layer. Deposition of an additional material which improves the wettability is also recommended.

The object of the present invention is to specify a method for improving the wettability of a rotating electrode in a gas discharge lamp and a discharge lamp with a readily wettable rotatable electrode, which require no thermal pre-treatment of the electrode with the liquid medium that is to be applied.

DESCRIPTION OF THE INVENTION

This object is achieved with the method and the apparatus in accordance with claims 1 and 7. Advantageous configurations of the method and the apparatus form the subject matter of the dependent claims or can be inferred from the following description together with the exemplary embodiments.

Under the proposed method, the edge surface of the rotating electrode of the discharge lamp, to which the liquid medium is to be applied, is microstructured by means of external processing. This microstructuring can extend over the entire edge surface electrode or also only extend over the region from which the liquid medium for the gas discharge is evaporated. The liquid medium is preferably a molten metal. The edge surface of the electrode in this context is to be understood as the outer circumferential surface at a distance from the rotational axis, which extends between the opposite side faces. The electrodes are preferably formed in the shape of circular discs or wheels. The edge surface itself can also have a macroscopic profile, for example, a stepped shape, in the cross-section parallel to the rotational axis.

The microstructuring of the edge surface of the electrode in the proposed method is carried out by external processing, for example, by mechanical machining of the surface, or by processing with energetic radiation, preferably by processing with one or more laser beams. Of course, the structuring can also be carried out by other types of energetic radiation, such as ion beams or electron beams.

The structural dimensions of the microstructure produced are preferably chosen such that at least the depth or the width or the length of the structures is <=300 μm. The microstructure is intended to improve the adhesion of the liquid medium to the substrate material, i.e. the surface material of the electrode. The structural dimensions must then be selected such that the capillary forces for the liquid medium are large enough to increase the adhesion of the liquid medium to the edge surface compared to a smooth edge surface. To estimate suitable dimensions, for example, the so-called Bond constant B can be used, which describes the ratio of the capillary forces to the externally acting forces such as gravity or centrifugal force in the case of a rotating system. The Bond constant B is given by:

$$B = \frac{\rho \cdot a \cdot r^2}{\sigma}$$

In this equation ρ corresponds to the density of the liquid medium, r the typical structure size or structural dimension, a the acceleration and σ the surface tension of the liquid medium. Under the proposed method and the proposed gas discharge lamp, the capillary forces should be very much larger than the centrifugal force acting on the rotating electrode, i.e., preferably B<<1. In the following, an example is given for this case in which the structure size r is estimated with molten tin used as the liquid medium. Molten tin has a surface tension of σ=500 mN/m and a density of ρ=7.0 g/cm3. For an application involving a rotating electrode wetted with tin, with a typical radius R=10 cm and a rotation frequency of f=10 Hz, the resulting acceleration at the edge surface of the electrode is given by $a=(2\pi f)^2 * R=395$ m/s2. With the given material constants for molten tin, the condition B<<1 then leads to a typical structure size of r<<300 μm. This value of 300 μm can be regarded as an upper limit. The preferred structure size or structural dimension on the edge surface of the electrode is therefore selected in this case within the range from 10 μm or a few 10s of μm to a few 100 μm.

The proposed method and the associated apparatus exploit the fact that structures with dimensions of a few μm display different surface properties than smooth surfaces. The microstructuring primarily influences the wettability of liquid-carrying components. Due to the structuring of the rotating electrodes, a functionalized surface is obtained on the microscopic scale, which increases the wetting and adhesion of a liquid medium with this surface compared to a smooth surface. The structure can also be selected in such a way that it controls the fluid flow during the rotation, for example, steering it in a certain preferred direction or ensuring a uniform distribution over the surface.

The microstructure is preferably produced in such a way that it has a periodic or regular geometric pattern. For example, a microstructure can be produced with cruciform, honeycombed, trapezoidal, pyramid-shaped, circular, annular and/or linear elevations and/or indentations. Of course, this list is not exhaustive. Rather, the shape of the microstructure is chosen in such a way that it meets the desired requirements in each case, for example, in addition to the improved adhesion, also facilitating a rapid distribution of the liquid medium over the surface. In any case, the microstructuring leads to an improved wettability and adhesion of the liquid film to the edge surface of the rotating electrode and therefore facilitates higher rotation frequencies and in turn a higher power coupling into the electrode system. The microstructuring enables improved control over the film thickness and a homogeneous distribution of the liquid medium over the electrode.

A more homogeneous distribution of the liquid medium leads at the same time to an increase in the service life of the electrode system and/or of the gas discharge lamp in which the electrode system is used.

In the proposed method and the proposed gas discharge lamp it is also possible to apply a corresponding microstructure to the side faces, or at least to areas of the side faces adjacent to the edge face. For this purpose the side faces are preferably provided with a different microstructure to that of the edge faces. A different structuring in different areas of the edge surface is also possible, in particular a different microstructuring in the area where the liquid medium is evaporated by a laser beam, than in the remaining areas.

The proposed device for generating radiation by an electrically operated discharge, designated in the present patent application as a gas discharge lamp, has two electrodes which are separated at one point by a small distance for forming a discharge path and of which at least one electrode is mounted such that it can be rotated and driven about an axis passing through a centre of the electrode. Both electrodes are preferably implemented as electrode wheels and rotatably mounted. The apparatus also has a corresponding device for applying a liquid medium to an edge surface of one or both electrodes. In one configuration this device comprises a reservoir or container with the liquid medium, into which the respective electrode is immersed. Due to the rotation, the electrode then picks up the liquid medium on the edge surface and transports it to the site of the discharge. It goes without saying that there are other possible ways to apply the liquid medium to the surface of the electrode, such as via a nozzle or a partial border specially adapted to the electrode wheel. The apparatus can be configured in the same way as, for example, the gas discharge lamp of WO 2005/025280 A2 that was cited in the introduction to the description. The apparatus also comprises, of course, in a known manner, a device for generating the electrical discharge across the two electrodes and a device for evaporating the liquid medium at the discharge site, for example, a laser unit. In the proposed apparatus the edge surface of the at least one electrode has a microstructure produced by selective external processing. This microstructure and its possible configurations have already been explained in connection with the proposed method, and so will not be described further here. This also applies to the side faces of the at least one rotatable electrode, which can also be microstructured in corresponding manner.

The proposed method and the proposed gas discharge lamp are preferably applicable in domains in which EUV radiation or soft X-rays need to be generated. The improved wettability of the rotating electrode or electrodes facilitates a higher efficiency in the generation of radiation. The improved wettability can, of course, also be increased by additional measures, such as are known from the prior art, such as an additional plasma treatment.

BRIEF DESCRIPTION OF THE DRAWINGS

The proposed method and the associated apparatus are explained in more detail again below, based on exemplary embodiments in combination with the drawings. These show.

WAYS OF EMBODYING THE INVENTION

Figure 1:
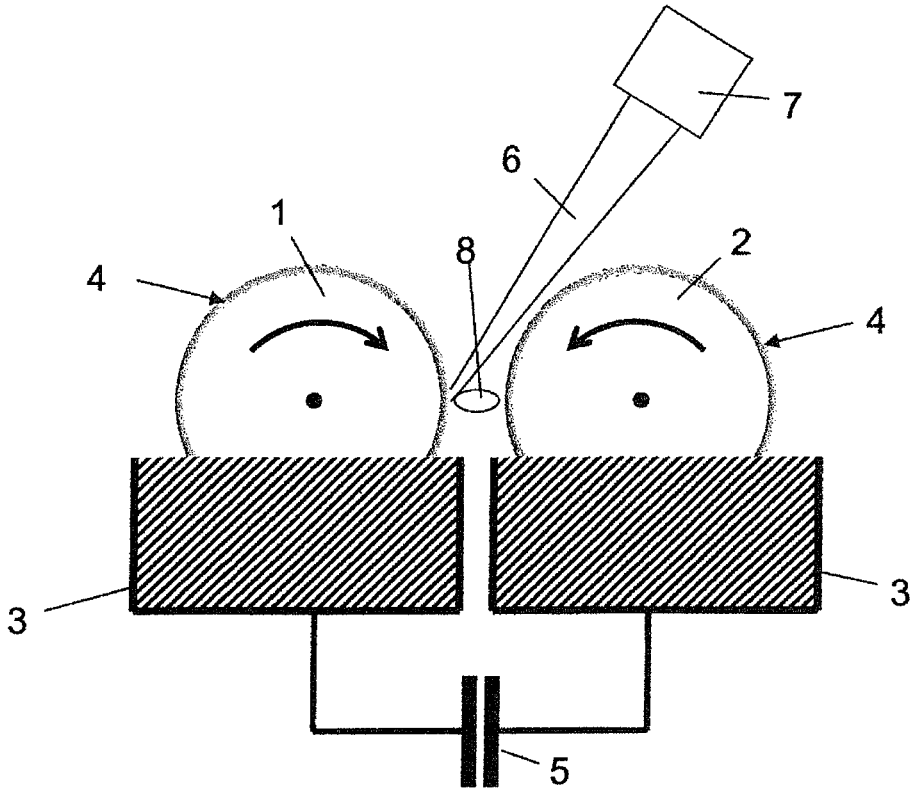
FIG. 1 an example of a gas discharge lamp that can be configured according to the proposed invention.

The proposed method for improving the wettability of the rotating electrodes can be applied, for example, in a gas discharge lamp for generating EUV radiation or soft X-ray radiation, as is indicated schematically in FIG. 1. This gas discharge lamp has two electrode wheels 1, 2 (cathode, anode) arranged a small distance apart from each other, so that at one point they form a gap for a discharge path. During the operation of the gas discharge lamp the two electrode wheels 1, 2 rotate about their rotational axes and in so doing, are immersed in two containers 3, which contain a molten metal, in the present example molten tin. Due to the rotation in the molten tin, a thin film 4 of tin is formed on the outer edge surface of the electrode wheels. The electrode wheels are electrically connected via the molten tin bath to a capacitor bank 5, by means of which a pulsed current flow is applied to them. The gas discharge 8 is ignited by evaporation of a part of the film of molten tin with a pulsed laser beam 6 from a laser source 7, as indicated schematically in the figure. The plasma 8 emits the desired EUV radiation or soft X-ray radiation. The electrodes are arranged in a vacuum chamber, which is not shown in the figure. Other elements, such as scrapers for setting a defined thickness of the tin film 4 on the electrodes, or screening elements, are also part of such a discharge lamp. Examples of such elements can be found in, for example, document WO 2005/025280 A2.

Figure 2:
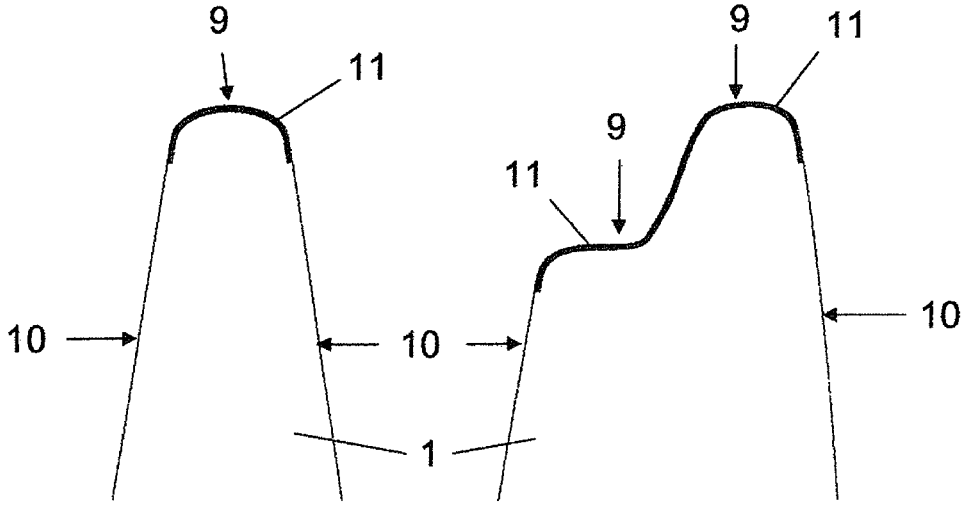
FIG. 2 two examples of the cross-sectional profile of an electrode wheel of a gas discharge lamp of this type.

FIG. 2 shows a cross-section of an edge region of one of the electrode wheels 1 of such a gas discharge lamp in two examples. In the case of the proposed gas discharge lamp the edge surface 9 of such an electrode wheel is microstructured in accordance with the proposed method. In the present example this microstructure 11 also extends over a small area of the two side faces 10 of the electrode wheel 1. The edge surface 9 of the electrode wheel can in this case also have a macroscopic structure in the cross-section shown, as can be seen in the example in the right-hand part of the figure.

Figure 3:
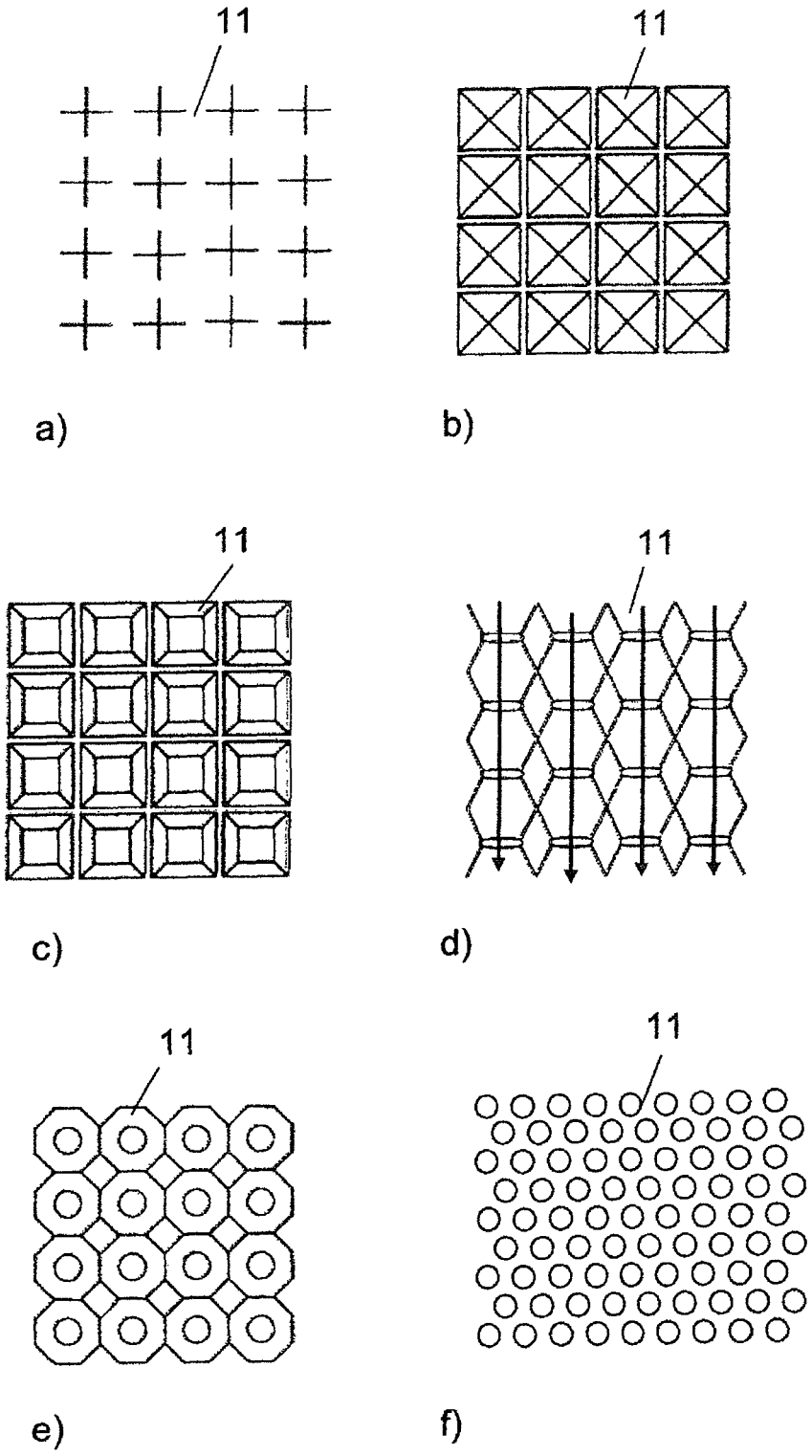
FIG. 3 different examples of geometric patterns of the microstructure on the edge or side surfaces of the electrodes.

FIGS. 3*a* to 3*f* show excerpts from different microstructures in plan view of the respective microstructure 11 in a schematic representation. FIG. 3*a* shows a structure with individual crosses, which, like the other structures shown, are distributed regularly or periodically over the microstructured surface. FIG. 3*b* shows a structure with pyramids arranged side-by-side, FIG. 3*c* a structure with trapezia arranged side-by-side. Cross structures can be manufactured very simply. The pyramids represent a special case of the trapezia, but have a greater surface area. In principle it is possible to manufacture trapezia with an available laser profile for the structuring very simply. FIG. 3*d* shows a groove structure with grooves extending from top to bottom in the illustration. A groove structure allows for different length scales to be combined, since the grooves can also be discontinuous in the longitudinal direction. FIG. 3*e* shows a honeycomb structure, FIG. 3*f* shows a structure with circles or rings. The honeycomb structure leads to a high degree of stability of the liquid film by allowing it to spread along the honeycomb structure. The ring or circular structure is particularly simple to describe mathematically, in order, for example, to be able to simulate the behaviour of the liquid film.

In principle, the structures shown can exist both in the form of elevations, for example, pyramidal elevations, or in the form of indentations, for example, pyramid-shaped indentations in the microstructure.

Figure 4:
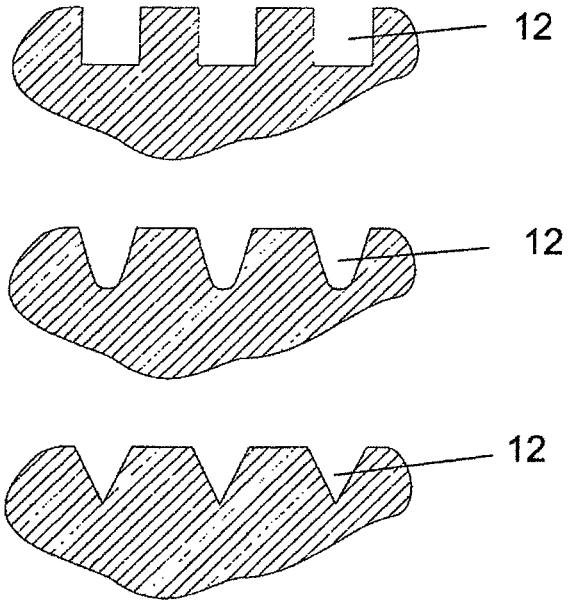
FIG. 4 three examples of a line- or groove-shaped microstructure in a cross-sectional view.

Another type of simple structuring consists in a pattern of lines, in which grooves 12 running in straight lines are produced in the surface. Each groove 12 has a constant rectangular, circular or triangular cross-section to a good approximation, as is indicated in the three examples of FIG. 4. These structures, in particular the nature of the cross-section, enable control parameters for the adhesion and/or distribution of the liquid film over the surface, such as the volume of the tin film or its wettability, to be selectively controlled or modified.

Figure 5:
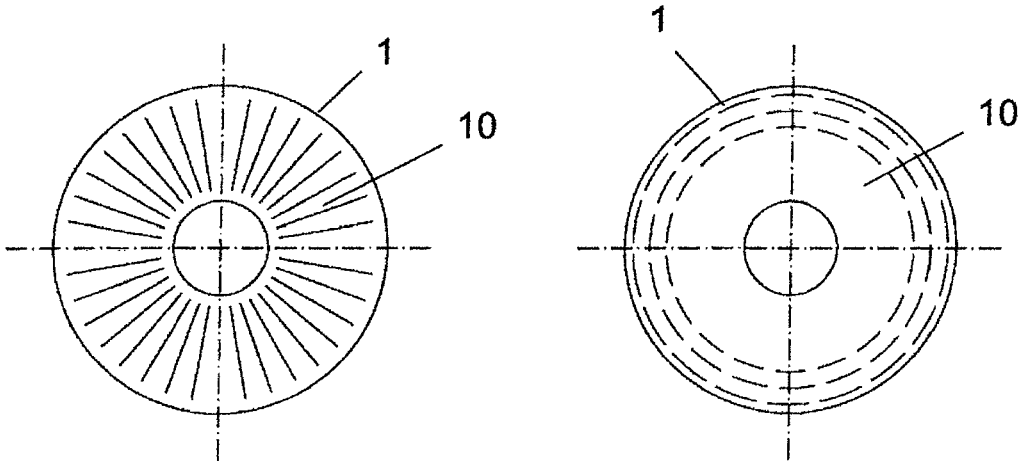
FIG. 5 two examples of a microstructuring of the side faces of the electrodes in a plan view of the side surfaces.

Finally, FIG. 5 shows two examples of a microstructuring of the side faces 10 of an electrode wheel 1 in plan view of one of the two side faces. In the left part of the figure the entire side face 10 of the electrode wheel 1 has been microstructured. The right-hand part of the figure shows an example in which only one area adjacent to the edge surface has been structured. By varying the nature of the structuring of the side faces 10, the flow of tin over these side faces to the edge surface of the electrode wheel can be selectively controlled. Therefore, for example, the tin can be supplied to the edge faces in a targeted manner, without large droplets being formed.

LIST OF REFERENCE NUMERALS

1 First electrode wheel
2 Second electrode wheel
3 Container with molten tin
4 Tin film
5 Capacitor bank
6 Pulsed laser beam
7 Laser light source
8 Plasma
9 Edge surface of the electrode wheel
10 Side face of the electrode wheel
11 Microstructure
12 Groove

The invention claimed is:

1. Method for forming a rotating electrode used with a liquid medium in a gas discharge lamp that generates EUV radiation or soft X-rays, in which the liquid medium is applied to an edge surface of the rotating electrode, comprising:

pre-processing an edge surface of the electrode to form external microstructures on said edge surface, wherein pre-processing said external microstructure has structural dimensions in the edge surface or in the edge surface and in side faces of the electrode, at least one of said dimensions being a width, a length or a depth less than 300 μm, said microstructures improving a wettability of the edge surface for the liquid medium.

2. Method according to claim 1, further comprising:

pre-processing side faces of the electrode that are adjacent to the edge surface to form microstructures in at least one area adjacent to the edge surface.

3. Method according to claim 1, further comprising:

pre-processing said external microstructure with a periodic geometric pattern in the edge surface or in the edge surface and in side faces of the electrode.

4. Method according to claim 1, further comprising:

pre-processing said external microstructure with cruciform, honeycombed, trapezoidal, pyramid-shaped, circular, annular, strip-like and/or linear elevations and/or indentations in the edge surface or in the edge surface and in side faces of the electrode.

5. Method according to claim 1, further comprising:

pre-processing the edge surface or the edge surface and side faces of the electrode that are microstructured with energetic radiation.

6. Apparatus for generating radiation by an electrically operated discharge for generating EUV radiation or soft X-rays, having two electrodes separated by a small distance to form a discharge path, and at least one electrode of which is mounted such that it can be rotated about an axis, and having a device for applying a liquid medium to an edge surface of the at least one electrode characterized in that the edge surface has a microstructure produced by external pre-processing, wherein the microstructure has structure dimensions, of which at least one width, length or depth is less than 300 μm, said microstructure improving a wettability of the edge surface for the liquid medium.

7. Apparatus according to claim 6, characterized in that the device for applying a liquid medium comprises a container for holding the liquid medium, into which the at least one electrode is immersed during the rotation.

8. Apparatus according to claim 6, characterized in that both electrodes are each mounted such that they can rotate about an axis, respectively, and have the microstructure in their edge surface.

9. Apparatus according to claim 6, characterized in that electrodes are formed in the shape of circular discs.

10. Apparatus according to claim 6, characterized in that side faces of the electrode or electrodes that are adjacent to the edge surface are also microstructured in at least one area adjacent to the edge surface.

11. Apparatus according to claim 6, characterized in that the microstructure has a periodic geometric pattern.

12. Apparatus according to claim 6, characterized in that the microstructure is formed by cross-shaped, honeycombed, trapezoidal, pyramid-shaped, circular, annular, lamellar and/or linear increases and/or indentations.

13. Electrode wheel, which in one edge surface has a microstructure produced by external pre-processing, said microstructure improving a wettability of the edge surface for a liquid medium, and is designed as an electrode for an apparatus according to claim 6.

14. An apparatus for generating radiation by an electrically operated discharge device, the apparatus comprising:

a container for holding a liquid medium; and two electrodes separated by a small distance to form a discharge path, wherein at least one of the electrodes is rotatably mounted about an axis and has an edge surface that contacts the liquid medium, and wherein said edge surface has pre-processed external microstructures improving a wettability of the edge surface for the liquid medium, wherein the microstructures have structure dimensions, of which at least one width, length or depth is less than 300 μm.

15. The apparatus according to claim 14, wherein both said electrodes are rotatably mounted about their respective axes, and each said edge surface has external microstructures.

16. The apparatus according to claim 14, wherein each said electrode has opposed side faces connected to said edge surface, and wherein said side faces are also microstructured in at least one area adjacent to said edge surface.

* * * * *